United States Patent [19]

Hunt

[11] 4,065,050

[45] Dec. 27, 1977

[54] SIGNAL DEVICE FOR RURAL TYPE MAILBOXES

[76] Inventor: Harrell E. Hunt, 152 Oakwood Estates, Scott Depot, W. Va. 25560

[21] Appl. No.: 763,032

[22] Filed: Jan. 27, 1977

[51] Int. Cl.[2] ..... A47G 29/12

[52] U.S. Cl. ..... 232/34; 232/35

[58] Field of Search ..... 232/35, 34, 17

[56] References Cited

U.S. PATENT DOCUMENTS

| | | | |
|---|---|---|---|
| 1,458,836 | 6/1923 | McDowell | 232/35 |
| 1,627,617 | 5/1927 | Nordin | 232/35 |
| 1,628,034 | 5/1927 | DeMier | 232/35 |
| 2,551,915 | 5/1951 | Turner | 232/34 |
| 2,693,314 | 11/1954 | Hunter | 232/35 |
| 2,797,860 | 7/1957 | Foster | 232/35 |
| 2,812,130 | 11/1957 | Abell | 232/35 |
| 3,291,386 | 12/1966 | Van Fleet | 232/35 |
| 3,523,639 | 8/1970 | Wieber | 232/35 |

*Primary Examiner*—Francis K. Zugel
*Attorney, Agent, or Firm*—John R. Walker, III

[57] ABSTRACT

Subject device is automatically tripped by manually opening the door of the mailbox. The device includes a frame which is intended to be attached to the lower edge of the mailbox. Pivotally attached to the frame is a signalstaff adapted for pivotal movement between an upright position and a recumbent cocked position. Attached to the upper end of the signalstaff is an omnidirectional signalhead which provides conspicuous evidence from any angle of view that the door of the mailbox has been opened. The signalstaff is held in the cocked position and/or selectively released therefrom by a novel trigger mechanism which includes an actuating lever disposed adjacent the door for operable engagement therewith and whereby the trigger mechanism is operated to enable biasing apparatus to carry the signalstaff to the upright position as the door is opened.

17 Claims, 15 Drawing Figures

FIG. 1
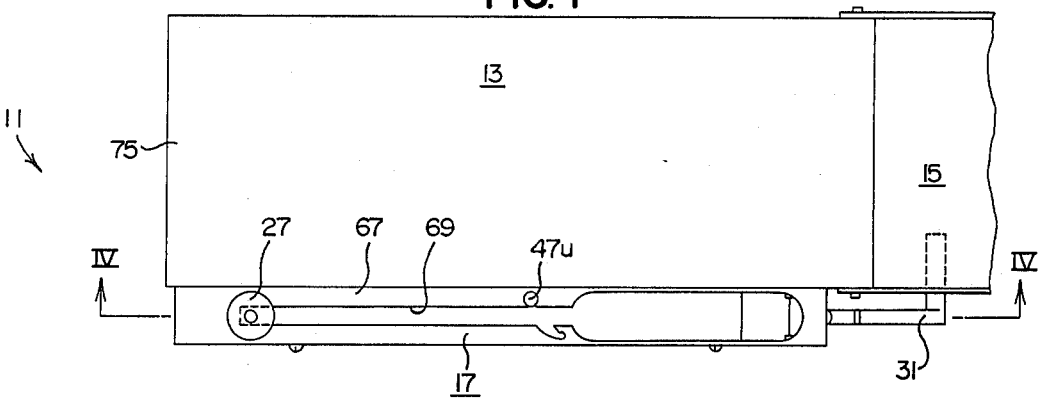
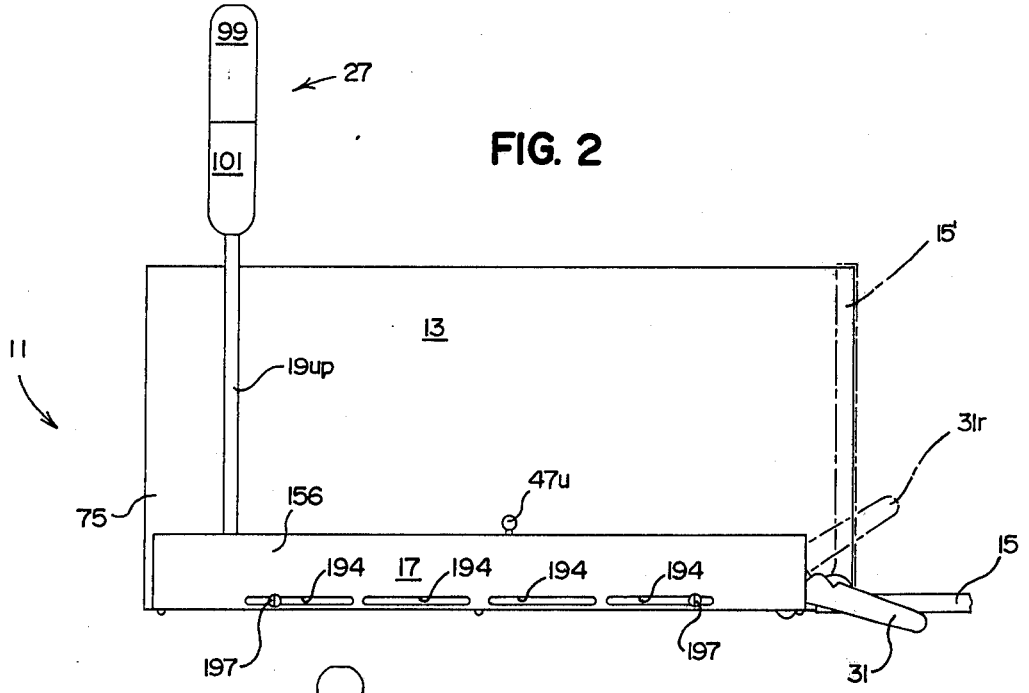
FIG. 2
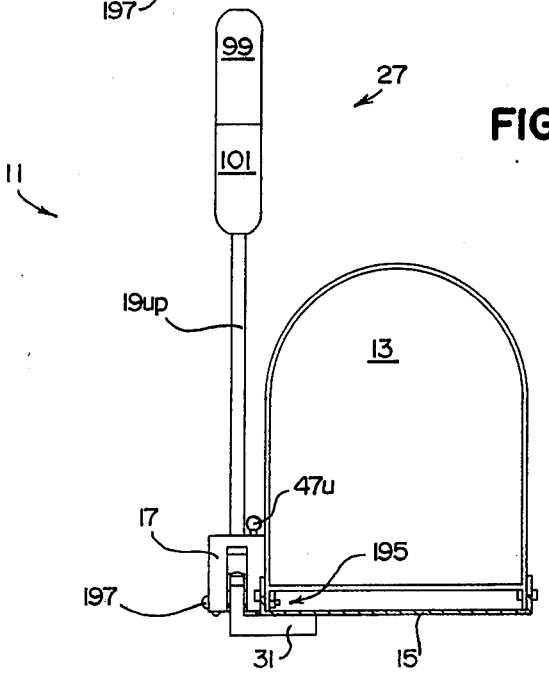
FIG. 3

SIGNAL DEVICE FOR RURAL TYPE MAILBOXES

BACKGROUND OF THE INVENTION

1. Field of the Invention

This invention relates to the field of signal devices for rural type mailboxes.

2. Description of the Prior Art

While the U.S. Postal Service does not officially approve or disapprove any signal device for rural mailboxes, they do provide certain guidelines for incorporating signal devices with rural mailboxes. For example, the signal device may not obstruct or otherwise interfere with the normal operation of the regular flag incorporated with the mailbox. Additionally, the device must not interfere with the operation of the door. Also, the device must not constitute a hazard to the mail carrier when serving the box, etc.

The state of the art of spring-actuated rural mailbox indicators or signal devices consists of a numerous variety of different devices. Very few of these prior signal devices were designed within the limitations set forth by the postal service. Many of these previous signal devices were designed with the intent of replacing the regular flag on the mailbox. Attachment of these former devices was usually done by drilling holes in the mailbox in predetermined locations and affixing with screws. The screws were exposed on the interior of the mailbox therefore constituting a hazard to the mail carrier. Other signal devices consist of clips and hooks exposed on the interior of the mailbox also constituting a hazard to the mail carrier. On some signal devices with door release mechanisms, normal operation of the door was impaired because of release pins being wedged between the door lip and the mailbox body. Some technical skill was required to properly align and affix most of these prior signal devices to the mailbox.

In addition, most of the signal devices were grossly unsightly with their mechanical parts being exposed. Once these prior devices were attached to the mailbox, they either had to be in the display position or in the cocked position. In other words, means were not provided to lock the signal flag in the down position and still allow the mailbox door to operate freely without releasing the signal flag. The majority of these prior signal flags were constructed of thin metal, therefore not allowing full visibility of the flag from all angles.

Applicant is aware of the following U.S. patents: U.S. Pat. No. 1,458,836 to McDowell; U.S. Pat. No. 2,217,310 to Fatur; U.S. Pat. No. 2,681,762 to Long et al; U.S. Pat. No. 2,812,130 to Abell; U.S. Pat. No. 2,874,896 to Hickman; U.S. Pat. No. 3,163,356 to Joehnk; and U.S. Pat. No. 3,606,141 to Taylor. None of the above patents suggest or disclose applicant's device.

SUMMARY OF THE INVENTION

The present invention is directed towards overcoming the disadvantages and problems relative to previous signal devices for rural type mailboxes. It is therefore an object of this invention to provide a rural mailbox signal device that is designed within all limitations set forth by the U.S. Postal Service wherein the attachment of the framework of the indicator is affixed to the side of the mailbox opposite the regular flag without exposing screws, clips, or pins that could constitute a hazard to the mail carrier, while at the same time providing an omnidirectional signalhead that is automatically actuated by a door release mechanism and which does not impair the normal operation of the mailbox door.

It is an important object of this invention to provide a signal device that may be attached to the side of any rural mailbox without requiring any drilling of holes or alteration of the mailbox in any way and will not require technical skill to align and affix the signal device to the mailbox.

It is a further object of this invention to provide a signal device in which all the mechanical parts and the omnidirectional signalhead are contained within a housing unit or framework structure so appearance of the omnidirectional signalhead is not unsightly.

It is another object of this invention to provide a signal device in which the omnidirectional signalhead may be locked in the recumbent or cocked position and still enable the door to be opened without releasing the omnidirectional signalhead, i.e., locking structure is provided to selectably enable the omnidirectional signalhead to remain in the recumbent cocked position irrespective of the operation of the mailbox door.

An important feature of the present invention is to provide a signal device wherein the omnidirectional signalhead is cylindrical in shape, for allowing full visibility of the signal head from any angle of sight around the mailbox.

It is still another object of this invention to provide a signal device that can be automatically reset by merely pushing the omnidirectional signalhead from the upright position to the recumbent cocked position inside the framework or housing unit, i.e., the signalhead being nestled within the framework.

All the foregoing objects are provided by the instant signal device which is automatically tripped by manually opening the door of the mailbox. The device includes a housing or framework structure which is intended to be attached along the lower edge of the mailbox. Pivotally attached to the framework is a signalstaff adapted for pivotal movement between an upright position and a recumbent cocked position. Attached to the upper end of the signalstaff is an omnidirectional signalhead which provides conspicuous evidence from any angle of view that the door of the mailbox has been opened. The signalstaff is held in the cocked position and/or selectively released therefrom by a novel trigger mechanism which includes an actuating lever disposed adjacent the door for operable engagement therewith and whereby the trigger mechanism is operated to enable biasing apparatus to carry the signalstaff to the upright position as the door is opened; therefore, protruding above the top of the mailbox. A locking arm is included that can be swung across the signalstaff, therefore locking it in the down or recumbent position and still allowing normal operation of the door and trigger mechanism but not allowing the omnidirectional signalhead to be displayed. The omnidirectional signalhead is rounded at the top and is provided with a socket. When the signalhead is manually pushed back down inside the housing or framework, the rounded surface of the signalhead engages a nib which is attached to the actuating lever thus urging or camming it forwardly until the nib is aligned with the socket, hence it is seated therein, thereby holding the signalhead in the cocked position while it is nestled in the housing unit or frame structure.

Ideally, the signal device of the present invention consists of a trigger torsion spring for urging the nib into the socket and a signalstaff torsion spring for urging the signalstaff to the upright position, both of which are preferably formed from stainless steel spring wire or the like. The remaining structure of the instant signal device may readily be configured from seven basic parts, if desired. These seven basic parts are: an upper housing unit, a lower housing unit, a signalstaff, an omnidirectional signalhead (including upper and lower half sections), a trigger actuating lever, and a crank-shaped locking member. All of the latter mentioned seven parts preferably are constructed of pressure injected molded thermoplastics. Thus, precluding any possibility of rust or corrosion; therefore, likelihood of seizure or jamming of any moving parts is obviated.

DESCRIPTION OF THE DRAWINGS

FIG. 1 is a top plan view of a typical rural mailbox shown with a cutoff portion of the door in an open position and with the signal device of the present invention shown in an upright position and attached thereto.

FIG. 2 is a side elevationsl view of the structure depicted in FIG. 1.

FIG. 3 is an end view of the structure depicted in FIG. 1 with the view being taken as from the right-hand side of FIG. 1.

DESCRIPTION OF THE PREFERRED EMBODIMENT

Figures 4A, 4B:
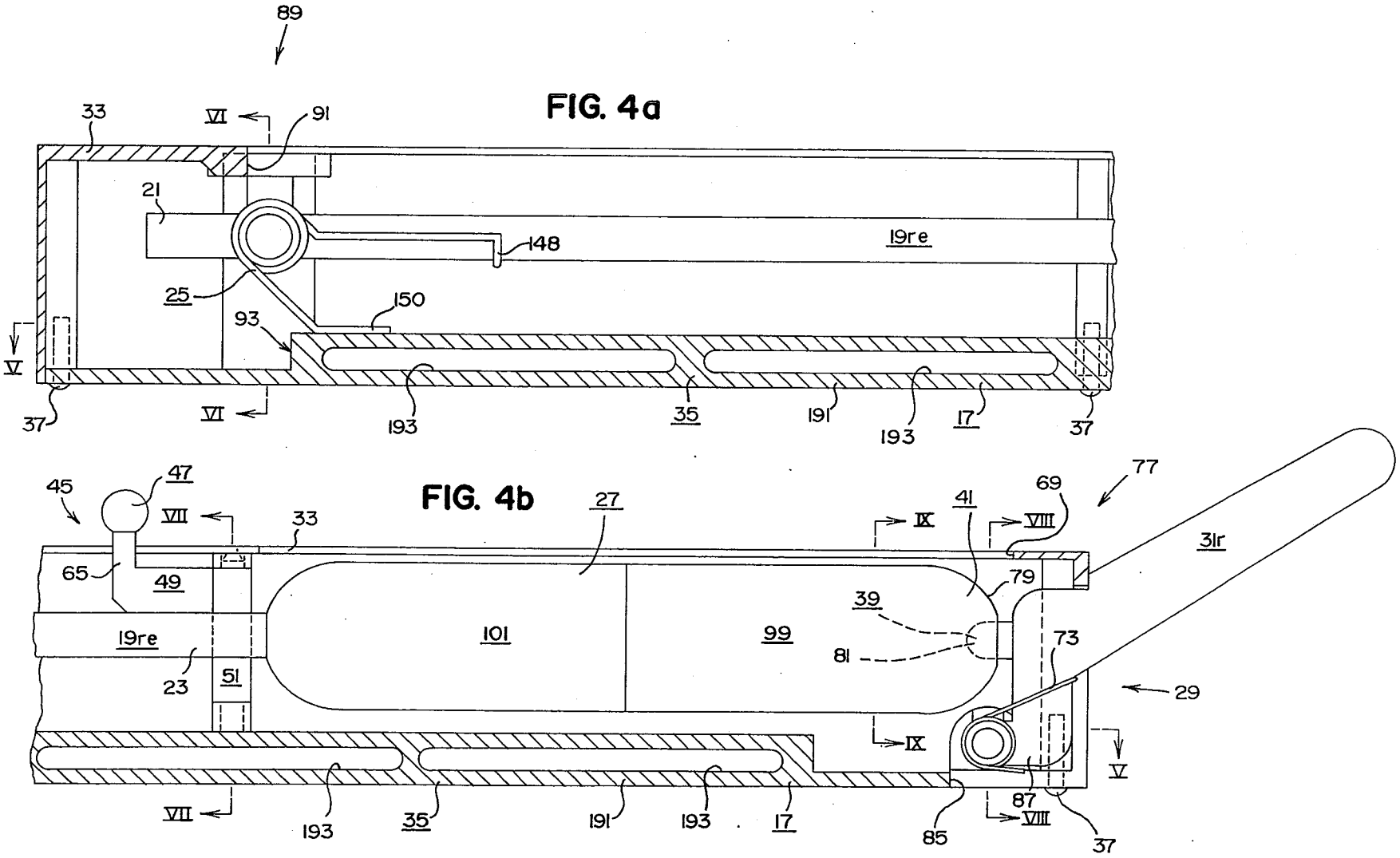
FIG. 4*a* combined with FIG. 4*b* jointly depict the signal device structure only as viewed along the sectional line IV—IV of FIG. 1; however, the signal device is now conveniently shown in a recumbent cocked position.

The signal device 11 of the present invention is for attachment to rural mailboxes, as at 13, of the type having an outwardly swinging door 15 substantially constituting the front end thereof. The device 11 includes elongated frame means or a housing unit 17 for attachment to the lowermost side of the mailbox with the longitudinal axis of the frame means 17 substantially coextending along a front to rear dimension of the mailbox 13, as clearly shown in FIGS. 1 through 3 of the drawings.

It will be understood by those skilled in the art that the mailbox 13 as depicted herein does not show the normal red flag associated therewith since the present invention has no significance therewith other than to simply state that the device 11 is intended to be installed so as not to obstruct or otherwise interfere with the normal operation of the regular flag.

The device 11 also includes signalstaff means 19 having lower and upper ends 21, 23 respectively thereto with the lower end 21 thereof being pivotally attached to the frame means 17 for pivotal movement between an upright position characterized by the small case suffix letters up, as 19*up* in FIGS. 2, 3 and a recumbent cocked position characterized by the small case suffix letters, as 19*re* in FIGS. 4 and 5 of the drawings.

Figures 5A, 5B, 6, 7, 8:
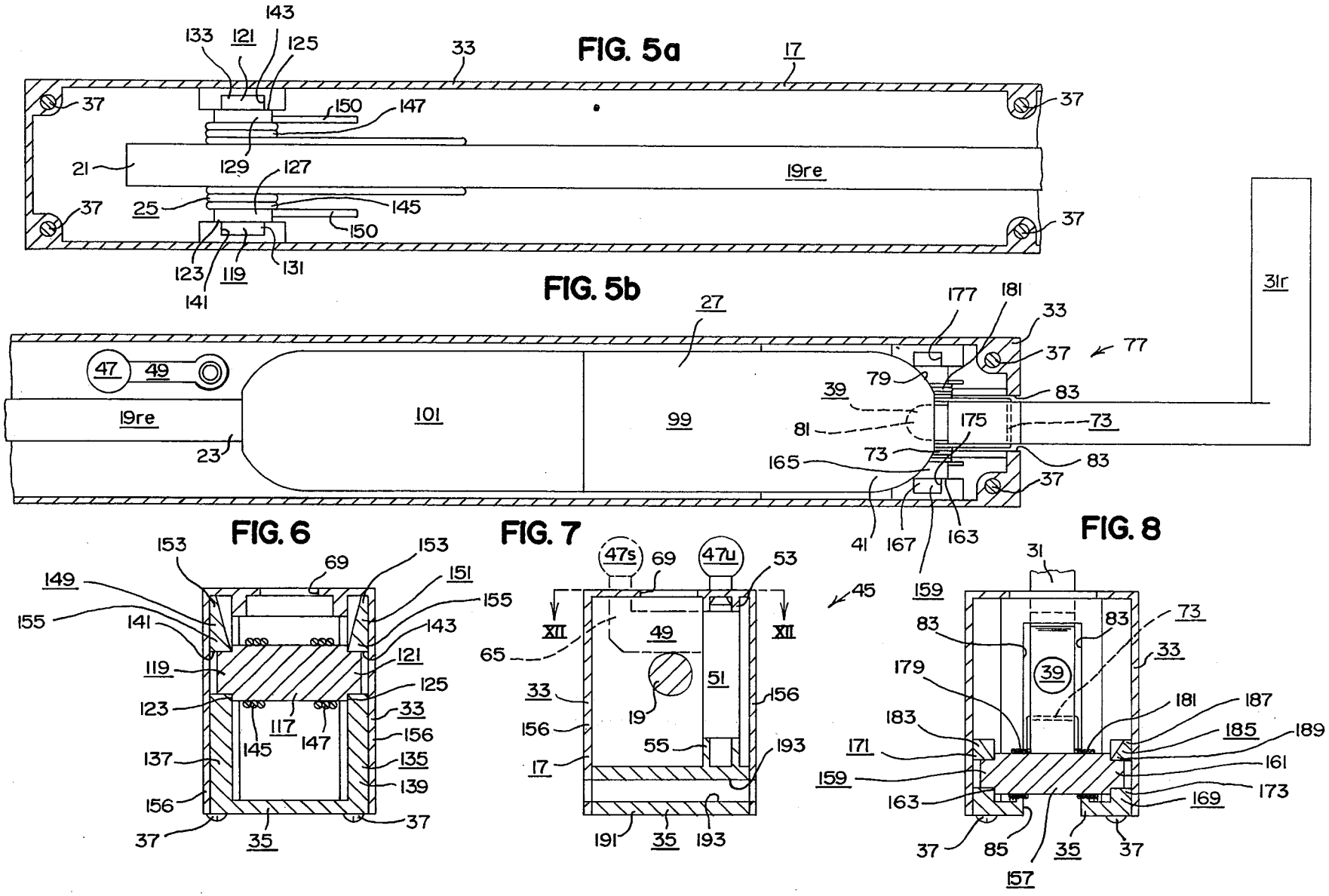
FIGS. 5*a* and 5*b* jointly depict the structure as viewed along the sectional line V—V of FIGS. 4*a*, 4*b*.
FIG. 6 is a sectional view taken as on the line VI—VI of FIG. 4*a*.
FIG. 7 is a sectional view taken as on the line VII—VII of FIG. 4*b*.
FIG. 8 is a sectional view taken as on the line VIII—VIII of FIG. 4*b*.

The device 11 also includes signalstaff bias means, e.g., a torsion spring 25 or the like, for yieldably urging the signalstaff means 19 toward the upright position 19*up*, i.e., the spring 25 is best shown in FIGS. 4*a* and 5*a* of the drawings.

Also included therewith in omnidirectional signalhead means 27 attached to the upper end 23 of the signalstaff means 19 for providing conspicuous evidence from any angle of view that the door 15 of the mailbox 13 has been opened. From FIGS. 2 and 3 of the drawings it may readily be seen that the signalhead means 27 is visibly displayed above the mailbox 13 when the signalstaff means 19 is in the upright position 19*up*.

The device 11 also includes trigger means generally characterized by the numeral 29 and pivotally attached to the frame means 17 for selectively holding the signalstaff means 19 in the recumbent cocked position 19*re* when the door 15 of the mailbox 13 is closed and for releasing the signalstaff means 19 as the door 15 is opened.

The trigger means 29 includes actuating lever means 31 disposed adjacent the door 15 for operable engagement therewith and whereby the trigger means 29 is operated to enable the signalstaff bias means or torsion spring 25 to carry the signalstaff means 19 to the upright position 19*up* as the door 15 is opened.

The frame means 17 preferably includes a boxlike top or upper member 33 and a base or lower member 35 as best shown in FIGS. 4 through 8 of the drawings. The upper and lower members 33, 35 are suitably attached one to the other, as with a plurality of screws 37 or the like.

The trigger means 29 includes a nib 39 attached to the actuating lever means 31, as by being integrally formed therewith, for engaging the omnidirectional signalhead 27 thus holding the signalstaff means 19 in the recumbent cocked position 19*re* in a manner as best viewed in FIGS. 4*b* and 5*b* of the drawings and to be fully disclosed. The distal end, as at 41, of the omnidirectional signalhead means 27 includes means defining a socket 43 for receiving the nib 39 when the door 15 of the mailbox 13 is in the closed position, i.e., provided the signalstaff means 19 has been manually placed in the recumbent cocked position 19*re* with the socket 43 being best shown in FIG. 10 of the drawings.

Figure 12:
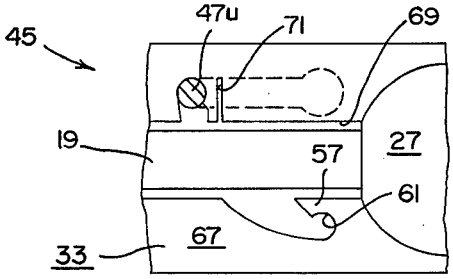
FIG. 12 is a partial sectional view taken as on the line XII—XII of FIG. VII showing certain structure in an unlocked position.
Figure 13:
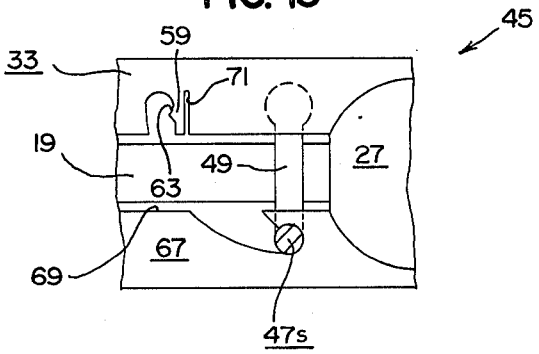
FIG. 13 is a view similar to FIG. 12 with the structure alluded to in FIG. 12 now being in a locked position as shown in FIG. 13.

The signal device 11 preferably includes lock means as indicated at 45 in FIGS. 4*b*, 5*b*, 7, 12, and 13 of the drawings, for selectively precluding the releasing of the signalstaff means 19 as the door 15 is opened. The lock means 45 includes crank-shaped means 47 pivotally mounted to the frame means 17 for pivotal movement between a locked or secured position 47*s* as shown in FIGS. 7, 13 and an unlocked position 47*u* as shown in FIGS. 7, 12 of the drawings. The crank-shaped means 57 includes an arm member 49 which is swingable transversely superjacent of the signalstaff means 19 when in the locked or secured position 47*s* whereby releasing of the signalstaff means 19 is precluded therewith in a manner as best shown in FIGS. 7 and 13 of the drawings.

From FIGS. 4*b*, 7 of the drawings it may be seen that the crank-shaped means 47 also includes a vertically disposed member 51 which is pivotally attached to the frame means 17. More specifically, the upper member 33 of the frame means 17 includes a cuplike bearing portion 53 for pivotally receiving the upper end of the vertical member 51 while the lower member 35 includes a cuplike bearing portion 55 for pivotally receiving the lower end of the vertical member 51. Thus, the crank-shaped means 47 may freely be moved between the locked or secured position 47*s* and the unlocked position 47*u*.

From FIGS. 12 and 13 of the drawings it may be seen that the lock means 45 also includes locking detent means 57 and unlocking detent means 59 for selectively yieldably captivating the crank-shaped means 47 in the respective locked or secured position 47*s* and unlocked position 47*u*. The locking detent means 57 defines at least in part a slot 61 (FIG. 12) and the unlocked detent means 59 defines at least in part a slot 63 (FIG. 13) for receiving at least a portion, as at 65, of the crank-shaped means 47, i.e., the portion 65 is best viewed in FIGS. 4*b* and 7 of the drawings.

The boxlike top or upper member 33 (which includes the detent means 57, 59) preferably is formed from a resilient substance, e.g., pressure injected molded thermoplastics or the like, and includes a platelike member 67 as viewed in FIG. 1 of the drawings which is provided with a slot 69 which has a shape adapted for allowing free passage therethrough of the signalstaff means 19 and the omnidirectional signalhead means 27. Accordingly, the resilient nature of the lock detent means 57 which defines in part the slot 69 enables the crank-shaped means 47 or the portion 65 thereof to urge the detent means 57 inwardly toward the slot 69 as the crank-shaped means 47 is moved into the locked or secured position 47*s*. In like fashion, a slot 71 (FIGS. 12, 13) is provided in the platelike member 67 for enabling the unlocked detent means 59 to be urged toward the slot 71 when moving the crank-shaped means 47 to the unlocked position 47*u*.

The trigger means 29 includes trigger bias means, e.g., a torsion spring 73 or the like as best shown in FIGS. 4*b* and 5*b*, for yieldably urging the nib 39 toward the rearward portion, as at 75 in FIGS. 1 and 2, of the mailbox 13 by merely moving the door 15 to the closed position 15' (FIG. 2) with the actuating lever means 31 being moved by the trigger bias means 73 to a reset position simply shown by the numeral 31 and the small letter r suffix (as 31*r* FIG. 2) as the door moves to the closed position 15'. However, it should be pointed out that FIGS. 4*a*, 4*b*; 5*a*, 5*b* depict the signalstaff means 19 in the recumbent position 19*re*, and the actuating lever means 31 is depicted in the reset position 31*r* therein.

The device 11 includes reset means generally indicated at 77 in FIGS. 4*b*, 5*b* of the drawings for automatically cocking the signalstaff means 19 as it is manually moved into the recumbent cocked position 19*re*. It will be appreciated by those skilled in the art that the operation and function of the reset means 77 depends at least in part upon cooperation of the trigger bias means 73; therefore, it is somewhat difficult to ignore the trigger bias means 73 when describing the reset means 77. However, the reset means 77 enables the nib 39 to be automatically received in the socket 43, i.e., provided the door 15 of the mailbox 13 is in the closed position 15'.

Figure 10:
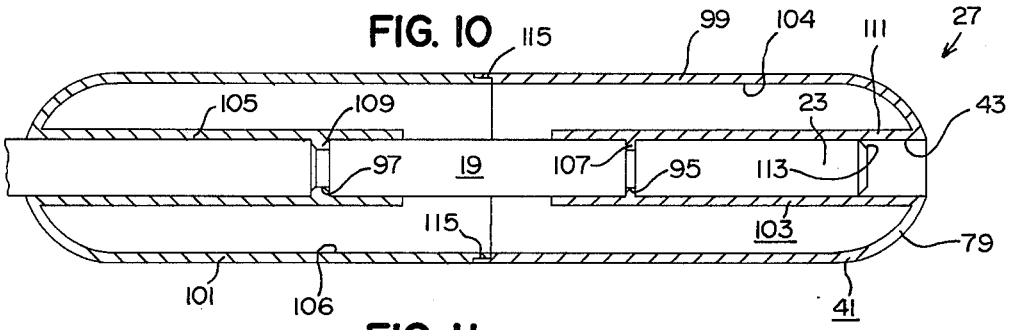
FIG. 10 is a partial view taken as on the line X—X of FIG. 9.

With due consideration to the cooperative trigger bias means 73, the reset means 77 includes cam means 79 established at least in part by the distal end 41 of the omnidirectional signalhead means 27 with the cam means 79 terminating at the lip edge of the socket 43, as best shown in FIG. 10 of the drawings. From FIGS. 4*b* and 5*b* of the drawings it may be seen that the nib 39 is provided with a cam follower bulbous-shaped distal end; as at 81 in FIGS. 4*b*, 5*b*; which slidably engages the cam means 79 as the signalstaff means 19 is manually placed into the recumbent cocked position 19*re* thus overpowering the trigger bias means 73 until such time as the socket 43 moves into alignment with the nib 39 hence the nib 39 is urged into the socket 43 by the trigger bias means 73.

It should be understood that the boxlike top or upper member 33 thereof is provided with a suitable slot, as at 83 in FIGS. 5*b* and 8, for enabling free passage therethrough of the actuating lever means 31. Likewise, the lower member 35 is provided with a slot 85 (FIG. 8) to enable free passage therethrough of a knuckle-like portion 87 (FIG. 4*b*) of the actuating lever means 31.

From FIG. 4*a* of the drawings it may be seen that the device 11 includes signalstaff arrester means generally indicated at 89 and being attached to the frame means 17 for arresting the signalstaff means 19 as it is urged into the upright position 19 *up* by the signalstaff bias means or torsion spring 25. More specifically, the upper member 33 of the frame means 17 is provided with a stop portion 91 for engaging the signalstaff means 19, and the lower member 35 is provided with a stop portion 93 for simultaneously engaging the lower end 21 of the signalstaff means 19.

Figure 9:
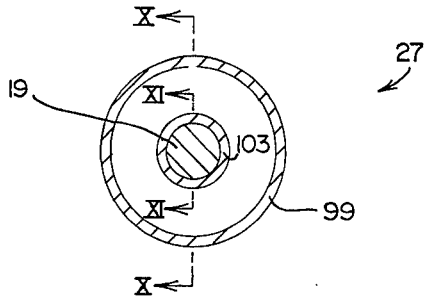
FIG. 9 is a sectional view taken as on the line IX—IX of FIG. 4*b*.
Figure 11:
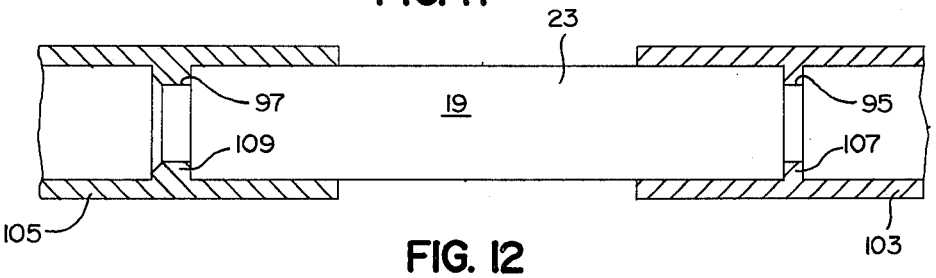
FIG. 11 is an enlarged partial view taken as on the line XI—XI of FIG. 9.

Particular attention is now directed towards FIGS. 9 through 11 of the drawings wherein it may be seen that the signalstaff means 19 is provided with first and second annular grooves 95, 97 disposed adjacent the upper end 23 thereof. Additionally, the omnidirectional signalhead means 27 includes upper and lower hollow complementary cylindrical members 99, 101 respectively having upper and lower tubular means 103, 105 coextending concentrically along the longitudinal axes thereof, i.e., the tubular means 103, 105 being respectively disposed in cavities 104, 106 provided in the cylindrical members 99, 101. The upper and lower tubular means 103, 105 respectively include first and second inwardly directed annular ridges 107, 109 for compatible engagement within the respective first and second annular grooves 95, 97 (provided in the signalstaff means 19) and for locking the omnidirectional signalhead means 27 to the signalstaff means 19 with the signalstaff means 19 being received within the upper and lower tubular means 103, 105 as clearly shown in FIGS. 10 and 11 of the drawings.

However, it should be observed that the signalstaff means 19 terminates a predetermined distance short of reaching entirely through the upper tubular means 103 with the distal end, as at 111 of the upper tubular means 103 opening outwardly of the upper cylindric member 99 for establishing and defining the previously mentioned socket 43.

It will be appreciated by those skilled in the art that since the first annular groove 95 is narrower than is the second annular groove 97 and the first annular ridge 107 is narrower than is the second annular ridge 109, the first annular groove 95 does not interfere with assembling the lower cylindrical member 101 with the upper end 23 of the signalstaff means 19. More specifically, the upper end 23 is inserted into the tubular member 105 during assembly and since the tubular means 103, 105 are expandable, the ridge 109 engages the chamfered portion, as at 113, which aids in expanding the ridge 109 as it passes over the chamfered portion 113. The cylindrical member 101 is forced toward the groove 97 and immediately upon the alignment of the ridge 109 with the groove 97, the resilient nature of the tubular means 105 causes the ridge 109 to be seated within the groove 97. However, the ridge 109 passes freely over the groove 95 since the ridge 109 is much broader than is the groove 95. The upper cylindrical member 99 is urged onto the upper end 23 in like manner as just described for the lower cylindrical member 101. The upper and lower cylindrical members 99, 101 preferably include annular mating shoulders, as at 115, for providing substantial weather tight fitness of the two members 99, 101, one with the other.

From the foregoing, it will be seen that the nib 39 thrustingly engages and selectively disengages the socket 43 when resetting the signalstaff means 19 to the position 19*re;* thus, the nib 39 effectively holds the signalstaff means 19 and the signalhead means 27 in the recumbent cocked position 19*re* when the door 15 of the mailbox 13 is in the closed position and the signalstaff means 19 having been manually placed in the recumbent cocked position 19*re.*

From FIGS. 5*a* and 6 of the drawings it may be seen that the device 11 include signal rockshaft means 117 for pivotally attaching the signalstaff means 19 to the frame means 17. Further, the rockshaft means 117 includes a pair of signal rockshaft elements 119, 121 fixedly attached at either side of the lower end 21 of the signalstaff means 19. The signal rockshaft elements 119, 121 respectively have annular shoulders 123, 125 respectively separating larger diameter portions 127, 129 from smaller diameter portions 131, 133. The frame means 17 (or more specifically the lower member 35 thereof) includes upwardly directed rear fork means 135 for pivotal engagement with the small diameter portions 131, 133 of the respective signal rockshaft elements 119, 121. The upwardly directed rear fork means 135 includes a pair of rearward upright resilient members 137, 139 respectively provided with a pair of signal pivot apertures 141, 143 respectively having sizes compatible with the smaller diameter portions 131, 133 for pivotal engagement therein. The previously mentioned signalstaff bias means 25 preferably includes signal coil spring means having a pair of coil members 145, 147 for respectively convolutely engaging the larger diameter portions 127, 129, as clearly shown in FIGS. 5*a* and 6 of the drawings, for yieldably urging the signalstaff means 19 toward the upright position 19*re,* i.e., a cradle-like mid-portion 148 engages the signalstaff means 19 while end portions 150 restingly engage the base 35.

In order to facilitate assembling the signalstaff means 19 with the rear fork means 135, the rearward upright resilient members 137, 139 respectively include a pair of rearward camlike tapered elements 149, 151 (as best shown in FIG. 6 of the drawings) extending from thin portions 153 thereof disposed adjacent the upper distal ends of the members 137, 139 to thick portions 155 thereof disposed adjacent the rim or lip edges of the signal pivot apertures 141, 143.

From the foregoing it will be appreciated bo those skilled in the art that the signal rockshaft means 117 is simply urged between the upright resilient members 137, 139 during assembly with the cam-like tapered elements 149, 151 urging the resilient members 137, 139 to spread apart until alignments of the small diameter portions 131, 133 with the respective apertures 141, 143 are achieved, hence the resilient members 137, 139 snap back into their normal relaxed position. In this regard, it should also be mentioned that the boxlike top or upper member 33 aids in conjoining the resilient members 137, 139 with the signal rockshaft means 117, since side panels, as at 156 in FIGS. 2, 6, overlappingly engage the upright members 137, 139.

From FIGS. 5*b* and 8 of the drawings it may be seen that the device 11 includes trigger rockshaft means 157 which functions in somewhat the same manner as just described for the signal rockshaft means 117, i.e., for pivotally attaching the actuating lever means 31 to the frame means 17. The trigger rockshaft means 157 includes a pair of trigger rockshaft elements 159, 161 fixedly attached at either side of the actuating lever means 31. Each of the trigger rockshaft elements, e.g., the rockshaft element 159, has an annular shoulder 163 separating a larger diameter portion 165 (FIG. 5*b*) of the trigger rockshaft element 159 from a smaller diameter portion 167 thereof. The frame means 17 (or more specifically the lower member 35 thereof) includes upwardly directed front fork means 169 for pivotal engagement with the smaller diameter portions 167 of the trigger rockshaft means 157. More specifically, the upwardly directed front fork means 169 includes a pair of forward upright resilient members 171, 173 respectively provided with a pair of trigger pivot apertures 175, 177 respectively having sizes compatible with the smaller diameter portions 167 of the trigger rockshaft elements 159, 161 for pivotal engagement therein. Additionally, the previously mentioned trigger bias means 73 includes a pair of coil spring members 179, 181 for respectively convolutely engaging the larger diameter portions 165 of the trigger rockshaft elements for yieldably urging the actuating lever means 31 toward the rearward portion 75 of the mailbox 13 or to the reset position 31*r.*

The forward upright resilient members 171, 173 respectively include a pair of forward cam-like tapered elements 183, 185 each of which extend from thin portions 187 disposed adjacent the upper distal ends thereof to thick portions 189 disposed adjacent the rim or lip edges of the trigger pivot apertures 175, 177. It will be appreciated by those skilled in the art that the assembly of the trigger rockshaft means 157 with the front fork means 169 is substantially identical to the above-mentioned disclosure pertaining to the assembly of the signal rockshaft means 117 with the rear fork means 145. Accordingly, it would appear to be redundant to repeat that phraseology at this point.

The base of lower member 35 includes base means, as at 191 in FIG. 7, defining a plurality of elongated attachment apertures, as at 193, which extend parallel with the longitudinal axis of the frame means 17 for facilitating attaching the signal device 11 to various different configured rural mailboxes 13. The overlapping side panels 156 also are provided with elongated apertures, as at 194 in FIG. 2, which coincide with the apertures 193 for accomplishing the same purpose as the apertures 193. The locations of the plurality of elongated attachment apertures 193, 194 are calculated to coincide with certain randomly spaced apertures (not shown) normally provided along the lower marginal edge, as at 195 (FIG. 3), of rural mailboxes 13. A plurality of bolts, as at 197 or the like, are shown in FIGS. 2,

3 of the drawings for attaching the device 11 to the mailbox 13.

Although the invention has been described and illustrated with respect to a preferred embodiment thereof, it is to be understood that it is not to be so limited since changes and modifications may be made therein which are within the full intended scope of the invention.

I claim:

1. A signal device for attachement to rural mailboxes of the type having an outwardly swinging door substantially constituting the front end thereof, said signal device comprising elongated frame means for attachment to the lowermost side of the mailbox with the longitudinal axis of said frame means substantially coextending along a front to rear dimension of the mailbox, signalstaff means having lower and upper ends thereto with said lower end thereof being pivotally attached to said frame means for pivotal movement between an upright position and a recumbent cocked position, signalstaff bias means for yieldably urging said signalstaff means toward said upright position, omnidirectional signalhead means attached to said upper end of said signalstaff means for providing conspicuous evidence from any angle of view that the door of the mailbox has been opened, trigger means pivotally attached to said frame means for selectively holding said signalstaff means in said recumbent cocked position when the door of the mailbox is closed and for releasing said signalstaff means as the door is opened, said trigger means including actuating lever means disposed adjacent the door for operable engagement therewith and whereby said trigger means is operated to enable said signalstaff bias means to carry said signalstaff means to said upright position as the door is opened, and lock means for precluding movement of said signalstaff means upon the releasing of said signalstaff means by said trigger means as the door of the mailbox is opened.

2. The device as set forth in claim 1 in which said lock means includes crank-shaped means pivotally mounted to said frame means for pivotal movement between locked and unlocked positions and having an arm member which is swingable transversely superjacent of said signalstaff means when in said locked position whereby releasing of said signalstaff means is precluded therewith.

3. The device as set forth in claim 2 in which said lock means includes locking detent means and unlocking detent means for selectively yieldably captivating said crank-shaped means in said respective locked and unlocked positions, said locking and unlocking detent means respectively defining at least in part a pair of slots for receiving at least a portion of said crank-shaped means.

4. A signal device for attachment to rural mailboxes of the type having an outwardly swinging door substantially consituting the front end thereof, said signal device comprising elongated frame means for attachment to the lowermost side of the mailbox with the longitudinal axis of said frame means substantially coextending along a front to rear dimension of the mailbox, signalstaff means having lower and upper ends thereto with said lower end thereof being pivotally attached to said frame means for pivotal movement between an upright position and a recumbent cocked position, signalstaff bias means for yieldably urging said signalstaff means toward said upright position, omnidirectional signalhead means attached to said upper end of said signalstaff means for providing conspicuous evidence from any angle of view that the door of the mailbox has been opened, and trigger means pivotally attached to said frame means for selectively holding said signalstaff means in said recumbent cocked position when the door of the mailbox is closed and for releasing said signalstaff means as the door is opened, said trigger means including actuating lever means disposed adjacent the door for operable engagement therewith and whereby said trigger means is operated to enable said signalstaff bias means to carry said signalstaff means to said upright position as the door is opened, said signalstaff means being provided with first and second annular grooves disposed adjacent the upper end thereof, said omnidirectional signalhead means including upper and lower complementary cylindric members respectively having upper and lower tubular means coextending concentrically along the longitudinal axes thereof, and said upper and lower tubular means respectively including first and second inwardly directed annular ridges for compatible engagement within said respective first and second annular grooves provided in said signalstaff means and for locking said omnidirectional signalhead means to said signalstaff means with said signalstaff means being received within said upper and lower tubular means.

5. The device as set forth in claim 4 in which said signalstaff means terminates a predetermined distance short of reaching entirely through said upper tubular means with the distal end of said upper tubular means opening outwardly of said upper cylindric member for establishing and defining a socket.

6. The device as set forth in claim 5 in which said trigger means includes a nib attached to said actuating lever means for thrustingly engaging and selectively disengaging said socket, thus said nib effectively holds said signalstaff means and said signalhead means in said recumbent cocked position when the door of the mailbox is in the closed position and said signalstaff means having been manually placed in said recumbent cocked position.

7. A signal device for attachement to rural mailboxes of the type having an outwardly swinging door substantially consituting the front end thereof, said signal device comprising elongated frame means for attachment to the lowermost side of the mailbox with the longitudinal axis of said frame means substantially coextending along a front to rear dimension of the mailbox, signalstaff means having lower and upper ends thereto with said lower end thereof being pivotally attached to said frame means for pivotal movement between an upright position and a recumbent cocked position, signalstaff bias means for yieldably urging said signalstaff means toward said upright position, omnidirectional signalhead means attached to said upper end of said signalstaff means for providing conspicuous evidence from any angle of view that the door of the mailbox has been opened, trigger means pivotally attached to said frame means for selectively holding said signalstaff means in said recumbent cocked position when the door of the mailbox is closed and for releasing said signalstaff means as the door is opened, said trigger means including actuating lever means disposed adjacent the door for operable engagement therewith and whereby said trigger means is operated to enable said signalstaff bias means to carry said signalstaff means to said upright position as the door is opened, and signal rockshaft means for pivotally attaching said signalstaff means to said frame means, said signal rockshaft means includes a pair of signal rockshaft elements fixedly attached at either side of said lower end of said signalstaff means, each of said signal rockshaft elements having an annular shoulder separating a larger diameter portion of said signal rockshaft element from a smaller diameter portion thereof, said frame means being provided with a pair of signal pivot apertures respectively having sizes compatible to the smaller diameter portions of said pair of signal rockshaft element for pivotal engagement therein, and said signalstaff bias means including signal coil spring means having a pair of coil members for respectively convolutely engaging the larger diameter portions of said signal rockshaft element for yieldably urging said signalstaff means toward said upright position, said frame means including upwardly directed rear fork means for pivotal engagement with said smaller diameter portions of said signal rockshaft elements, said upwardly directed rear fork means including a pair of rearward upright resilient members provided with said signal pivot apertures, said rearward upright resilient members respectively including a pair of rearward cam-like tapered elements extending from thin portions thereof disposed adjacent the upper distal ends thereof to thick portions thereof disposed adjacent the rim edges of said signal pivot apertures.

8. A signal device for attachment to rural mailboxes of the type having an outwardly swinging door substantially constituting the front end thereof, said signal device comprising frame means for attachment to the mailbox, signalstaff means having lower and upper ends thereto with said lower end thereof being pivotally attached to said frame means for pivotal movement between an upright position and a recumbent cocked position, signalstaff bias means for yieldably urging said signalstaff means toward said upright position, signalhead means attached to said upper end of said signalstaff means for providing conspicuous evidence that the door of the mailbox has been opened, trigger means for selectively holding said signalstaff means in said recumbent cocked position when the door of the mailbox is closed and for releasing said signalstaff means as the door is opened, said trigger means including actuating lever means disposed adjacent the door for operable engagement therewith and whereby said trigger means is operated to enable said signalstaff bias means to carry said signalstaff means to said upright position as the door is opened, and lock means for precluding the movement of said signalstaff means upon releasing of said signalstaff means by said trigger means as the door of the mailbox is being opened.

9. The device as set forth in claim 8 in which said trigger means includes a nib attached to said actuating lever means for engaging said omnidirectional signalhead means thus holding said signalstaff means in said recumbent cocked position, and the distal end of said omnidirectional signalhead means includes means defining a socket for receiving said nib when the door of the mailbox is in the closed position and said signalstaff means having been manually placed in said recumbent cocked position.

10. The device as set forth in claim 9 in which is included trigger bias means for yieldably urging said nib toward the rearward portion of the mailbox by merely moving the door of the mailbox to the closed position with said actuating lever means and said door both moving in unison during the opening and closing action of the door.

11. The device as set forth in claim 10 in which is included reset means for automatically cocking said signalstaff means at it is manually moved into said recumbent cocked position, said nib being automatically received in said socket provided the door of the mailbox is in the closed position.

12. The device as set forth in claim 11 in which said reset means includes cam means established at least in part by the distal end of said omnidirectional signalhead means with said cam means terminating at the lip edge of said socket, and said nib being provided with a cam follower bulbous-shaped distal end which slidably engages said cam means as said signalstaff means is manually placed into said recumbent cocked position thus overpowering said trigger bias means until such time as said socket moves into alignment with said nib hence the nib being urged into said socket by said trigger bias means.

13. The device as set forth in claim 8 in which is included signalstaff arrester means attached to said frame means for arresting said signalstaff means as it is urged into said upright position by said signalstaff bias means.

14. The device as set forth in claim 8 in which is included signal rockshaft means for pivotally attaching said signalstaff means to said frame means, said signal rockshaft means includes a pair of signal rockshaft elements fixedly attached at either side of said lower end of said signalstaff means, each of said signal rockshaft elements having an annular shoulder separating a larger diameter portion of said signal rockshaft element from a smaller diameter portion thereof, said frame means being provided with a pair of signal pivot apertures respectively having sizes compatible to the smaller diameter portions of said pair of signal rockshaft element for pivotal engagement therein, and said signalstaff bias means including signal coil spring means having a pair of coil members for respectively convolutely engaging the larger diameter portions of said signal rockshaft element for yieldably urging said signalstaff means toward said upright position.

15. The device as set forth in claim 9 in which is included trigger rockshaft means for pivotally attaching said actuating lever means to said frame means, said trigger rockshaft means include a pair of trigger rockshaft elements fixedly attached at either side of said actuating lever means, each of said trigger rockshaft elements having an annular shoulder separating a larger diameter portion of said trigger rockshaft element from a smaller diameter portion thereof, said frame means being provided with a pair of trigger pivot apertures respectively having sizes compatible to the smaller diameter portions of said pair of trigger rockshaft elements for pivotal engagement therein, and trigger bias means for yieldably urging said nib toward the rearward portion of the mailbox by merely moving the door of the mailbox to the closed position with said actuating lever means and said door both moving in unison during the opening and closing action of the door, said trigger bias means including trigger coil spring means having a pair of coil members for respectively convolutely engaging the larger diameter portions of said trigger rockshaft elements for yieldably urging said actuating lever means toward the rearward portion of the mailbox.

16. The device as set forth in claim 8 in which said frame means includes base means defining a plurality of elongated attachment apertures extending parallel with the longitudinal axis of said frame means for facilitating attaching said signal device to various different configured rural mailboxes, the location of said plurality of elongated attachment apertures being calculated to coincide with certain apertures normally provided along the lower marginal edge of rural mailboxes.

17. A signal device for attachment to rural mailboxes of the type having an outwardly swinging door substantially constituting the front end thereof, said signal device comprising elongated frame means for attachment to the lowermost side of the mailbox with the longitudinal axis of said frame means substantially coextending along a front to rear dimension of the mailbox, signalstaff means having lower and upper ends thereto with said lower end thereof being pivotally attached to said frame means for pivotal movement between an upright position and a recumbent cocked position, signalstaff bias means for yieldably urging said signalstaff means toward said upright position, omnidirectional signalhead means attached to said upper end of said signalstaff means for providing conspicuous evidence from any angle of view that the door of the mailbox has been opened, trigger means pivotally attached to said frame means for selectively holding said signalstaff means in said recumbent cocked position when the door of the mailbox is closed and for releasing said signalstaff means as the door is opened, said trigger means including actuating lever means disposed adjacent the door for operable engagement therewith and whereby said trigger means is operated to enable said signalstaff bias means to carry said signalstaff means to said upright position as the door is opened, said trigger means including a nib attached to said actuating lever means for engaging said omnidirectional signalhead means thus holding said signalstaff in said recumbent cocked position, the distal end of said omnidirectional signalhead means including means defining a socket for receiving said nib when the door of the mailbox is in the closed position and said signalstaff means having been manually placed in said recumbent cocked position, trigger rockshaft means for pivotally attaching said actuating lever means to said frame means, said trigger rockshaft means including a pair of trigger rockshaft elements fixedly attached at either side of said actuating lever means, each of said trigger rockshaft elements having an annular shoulder separating a larger diameter portion of said trigger rockshaft element from a smaller diameter portion thereof, said frame means being provided with a pair of trigger pivot apertures respectively having sizes compatible to the smaller diameter portions of said pair of trigger rockshaft elements for pivotal engagement therein, and trigger bias means for yieldably urging said nib toward the rearward portion of the mailbox by merely moving the door of the mailbox to the closed position with said actuating lever means and said door both moving in unison during the opening and closing action of the door, said trigger bias means including trigger coil spring means having a pair of coil members for respectively convolutely engaging the larger diameter portions of said trigger rockshaft elements for yieldably urging said actuating lever means toward the rearward portion of the mailbox, said frame means including upwardly directed front fork means for pivotal engagement with said smaller diameter portions of said trigger rockshaft elements, said upwardly directed front fork means including a pair of forward upright resilient members provided with said trigger pivot apertures, said forward upright resilient members respectively including a pair of forward cam-like tapered elements extending from thin portions thereof disposed adjacent the upper distal ends thereof to thick portions thereof disposed adjacent the rim edges of said trigger pivot apertures.

* * * * *